US010059894B2

(12) United States Patent
Wang

(10) Patent No.: US 10,059,894 B2
(45) Date of Patent: Aug. 28, 2018

(54) GASIFIER

(71) Applicant: Jin Tong Wang, Prairieville, LA (US)

(72) Inventor: Jin Tong Wang, Prairieville, LA (US)

(73) Assignee: Southern University and A&M College, Baton Rouge, LA (US)

( * ) Notice: Subject to any disclaimer, the term of this patent is extended or adjusted under 35 U.S.C. 154(b) by 44 days.

(21) Appl. No.: 15/423,015

(22) Filed: Feb. 2, 2017

(65) Prior Publication Data

US 2018/0216020 A1 Aug. 2, 2018

(51) Int. Cl.

| | |
|---|---|
| ***C10J 3/82*** | (2006.01) |
| ***C10J 3/72*** | (2006.01) |
| ***C10J 3/30*** | (2006.01) |

(52) U.S. Cl.

CPC ..... *C10J 3/721* (2013.01); *C10J 3/30* (2013.01); *C10J 3/82* (2013.01); *C10J 2200/15* (2013.01); *C10J 2300/0946* (2013.01); *C10J 2300/0976* (2013.01); *C10J 2300/123* (2013.01); *C10J 2300/1238* (2013.01); *C10J 2300/1853* (2013.01)

(58) Field of Classification Search

CPC ..... C10J 2300/123; C10J 2300/1238

See application file for complete search history.

(56) References Cited

U.S. PATENT DOCUMENTS

| | | | | |
|---|---|---|---|---|
| 9,011,647 | B2 * | 4/2015 | Lissianski | C10G 1/00 204/156 |
| 9,074,152 | B2 | 7/2015 | Nielsen et al. | |
| 9,505,991 | B2 * | 11/2016 | Conner | C10L 5/442 |
| 9,518,235 | B2 * | 12/2016 | Chen | C10J 3/485 |
| 2014/0263202 | A1 * | 9/2014 | Partridge | B23K 10/02 219/121.48 |
| 2017/0095787 | A1 * | 4/2017 | Hong | H05H 1/30 |

OTHER PUBLICATIONS

AltEnergyMag, Microwave-Induced Plasma Gasification, http://www.altenergymag.com/content.php?post_type=1698.

* cited by examiner

*Primary Examiner* — Matthew J Merkling

(74) *Attorney, Agent, or Firm* — John B. Edel; Edel Patents LLC

(57) ABSTRACT

Gasifiers are disclosed that include multiple chambers, multiple microwave sources and multiple arc plasma torches. Such gasifiers may be configured to have a drain, an exhaust port and a path of fluid communication between the exhaust port and the drain. Under appropriate conditions, the gasifiers may eliminate undesired waste while at the same time delivering a significant net energy benefit to the operator of the gasifier.

12 Claims, 2 Drawing Sheets

GASIFIER

Gasifiers described herein may be used to treat waste and generate energy from that waste treatment. Certain gasifiers disclosed herein may have improved energy efficiency and produce cleaner syngas than prior gasifiers. Under appropriate conditions, the gasifiers may eliminate undesired waste while at the same time delivering a significant net energy benefit to the operator of the gasifier.

DETAILED DESCRIPTION

Example 1

Figure 1:
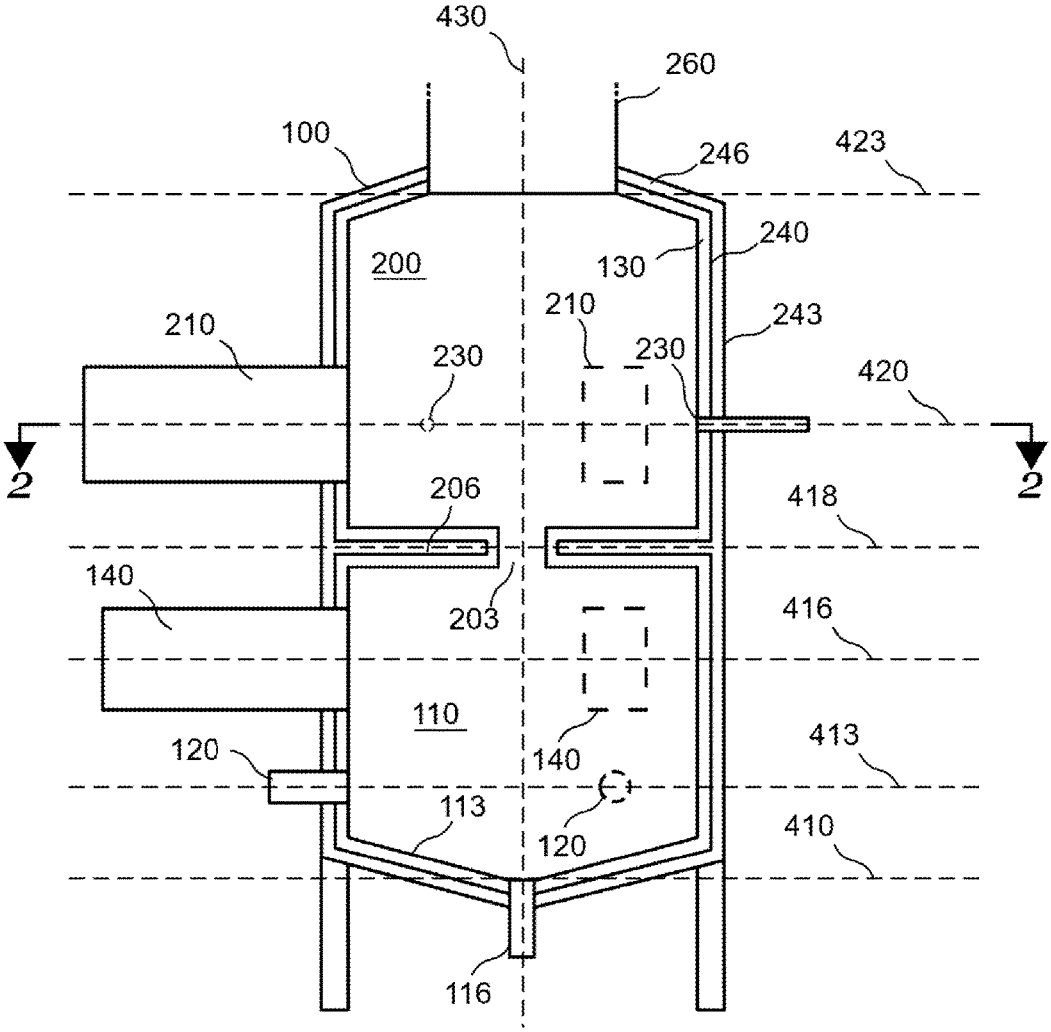
FIG. 1 shows a cut away elevation view of a gasifier.
Figure 2:
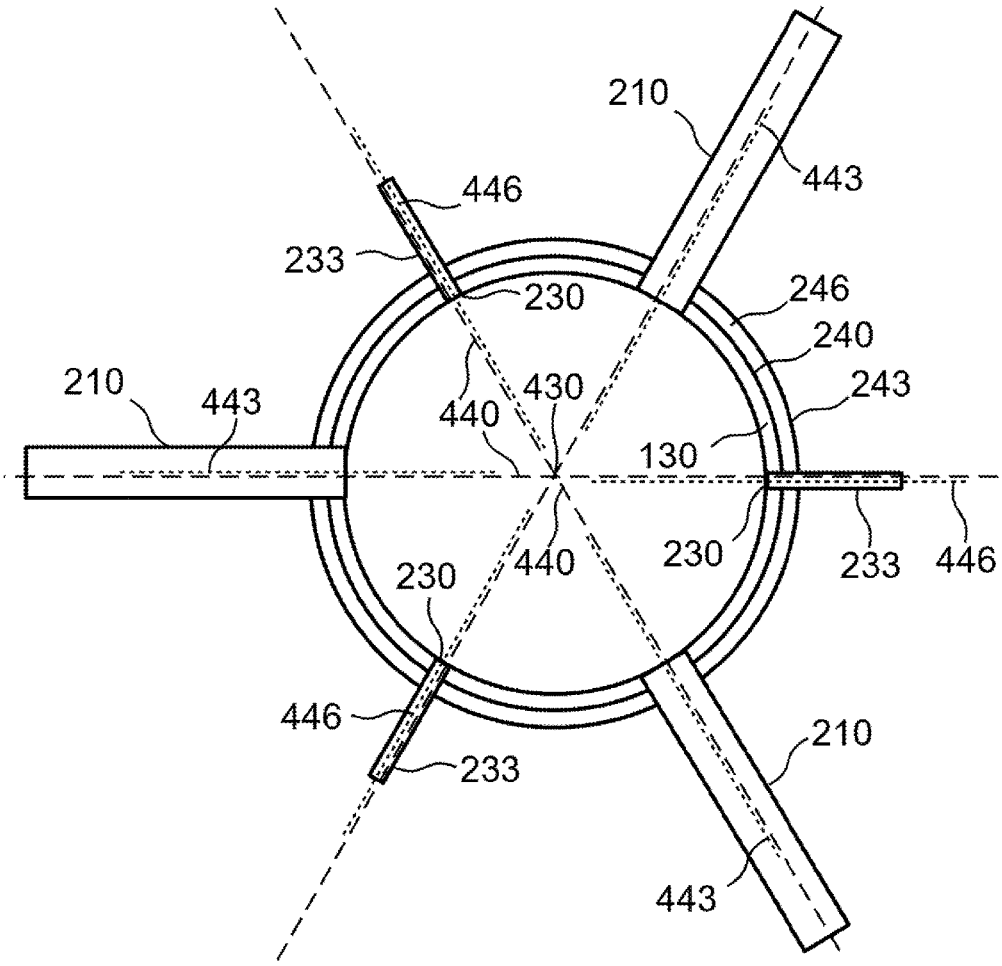
FIG. 2 shows a plan view cross section of the gasifier.

FIGS. 1 and 2 of the drawings show Gasifier 100, Arc plasma chamber 110, Arc plasma chamber floor 113, Chamber drain 116, Arc plasma torches 120, Refractory 130, Feed conveyors 140, Microwave plasma chamber 200, Internal orifice 203, Chamber separation wall 206, Microwave sources 210, Steam injection holes 230, Steam pipes 233, Inner steel wall 240, Outer steel wall 243, Coolant jacket 246, Gas exit 260, Arc plasma chamber bottom height 410, Arc plasma torch height 413, Feed conveyor height 416, Internal orifice height 418, Microwave source height 420, Microwave plasma chamber top height 423, Central axis 430, Radial lines 440, Microwave beam axes 443, and Steam axes 446.

Gasifier 100 as depicted in the figures is substantially cylindrical and contains two chambers, namely Arc plasma chamber 110 and Microwave plasma chamber 200. Arc plasma chamber 110 is substantially enclosed having an Arc plasma chamber floor 113 with a Chamber drain 116 and Internal orifice 203 at the top of Arc plasma chamber 110. Arc plasma chamber 110 is substantially lined with Refractory 130. Three Arc plasma torches 120 are equally spaced around the circumference of Arc plasma chamber 110 below the three Feed conveyors 140 such that Feed conveyors 140 drop feed material into the path of Arc plasma torches 120. There may be three or more Feed conveyors 140 and the number of feed conveyors may be equal to the number of the arc plasma torches. Microwave plasma chamber 200 is located above Arc plasma chamber 110 and separated from Arc plasma chamber 110 by Internal orifice 203 and Chamber separation wall 206. Chamber separation wall 206 may be a cooled dividing wall and may in particular be a liquid cooled dividing wall. Microwave plasma chamber 200 is also lined with Refractory 130 and is surrounded by three Microwave sources 210 and three Steam injection holes 230 all around the circumference of Microwave plasma chamber 200. Steam pipes 233 feed steam to Microwave plasma chamber 200 through Steam injection holes 230. Gasifier 100 is depicted as being jacketed with Inner steel wall 240 being adjacent to Refractory 130 and Coolant jacket 246 is located between Inner steel wall 240 and Outer steel wall 243. Gas exit 260 is located at the top of Microwave plasma chamber 200. Gas exit 260 may be designed as a heat exchange unit to recover heat from the gases exiting Microwave plasma chamber 200. The heat exchange unit may be designed to bring the temperature of the gas exiting Gasifier 100 down to a temperature between the temperature that would lead to condensation in the heat exchange unit and below the plasma/gas temperature threshold. The initial heat exchange unit may be designed for quick cooling such that the gas temperature leaving the initial heat exchange unit may for example be between 700 and 800° C.

FIG. 2 is a plan view cross section of Microwave plasma chamber 200. Central axis 430, depicted in both FIG. 1 and FIG. 2, is the axis most closely representing the symmetrical center of Gasifier 100. Radial lines 440 radiate from Central axis 430 with Radial lines 440 being separated from one another by 120°. Microwave sources 210 and Steam pipes 233 are spaced around the internal circumference of Microwave plasma chamber 200 in alternating fashion in approximate alignment with Radial lines 440. As depicted, Microwave beam axes 443, representing the central axis of the individual microwave beams, is offset from Radial lines 440 such that the individual microwave beams are not in perfect alignment with Central axis 430, but are rather configured to align slightly clockwise of Central axis 430 from a plan view perspective. Similarly, Steam axes 446 representing the central axis of the individual Steam injection holes 230 and Steam pipes 233, is offset from Radial lines 440 such that the individual steam jets are not in perfect alignment with Central axis 430, but are rather configured to align slightly clockwise of Central axis 430 from a plan view perspective. Although not depicted in a separate figure, Feed conveyors 140 and Arc plasma torches 120 are also configured to align slightly clockwise of Central axis 430 in a manner comparable to that described for Microwave sources 210 and Steam injection holes 230 above. For example, each of Arc plasma torches 120, Feed conveyors 140, Microwave sources 210 and Steam injection holes 230 may be positioned 5 mm clockwise of Central axis 430. The offsets may improve circulation in the chambers and may cause a vortex within one or both chambers.

The distance between Arc plasma chamber bottom height 410 and Arc plasma torch height 413 may be 300 mm. The distance between Arc plasma torch height 413 and Feed conveyor height 416 may be 300 mm. The distance between Feed conveyor height 416 and Internal orifice height 418 may be 240 mm. The distance between Internal orifice height 418 and Microwave source height 420 may be 285 mm. The distance between Microwave source height 420 and Microwave plasma chamber top height 423 may be 600 mm. The external diameter of Gasifier 100 may be 1000 mm.

As that phrase is used herein, "microwave plane" is the plane that is perpendicular to the flow of gas through Microwave plasma chamber 200 or the second chamber and that most nearly encompasses all of the microwave sources. Further the phrase "microwave cross-sectional area," as used herein, is the area within Microwave plasma chamber 200 or the second chamber that is part of the microwave plane. Further the phrase "microwave center," as used herein, is the point representing the centroid of the microwave cross-sectional area. The phrase "cross-sectional distance," as used herein, is the length of the shortest line segment fully crossing the microwave cross-sectional area that also passes through the microwave center. By way of example, the cross-sectional distance of the Gasifier 100 as depicted in FIGS. 1 and 2 would be the internal diameter of Microwave plasma chamber 200. Alternatively, if Microwave plasma chamber 200 had an internal space dimensioned as a cube, the cross-sectional distance would in most cases be the same as the length of a side of the cube.

The distance between the chamber drain and the gas exit may be characterized as the "reactor length." The reactor length divided by the cross-sectional distance may be characterized as the "gasifier aspect ratio." The gasifier aspect ratio may, for example, be 2.0 with certain examples falling between 0.8 and 6.0 and a significant number of those examples falling between 1.4 and 4.0.

Gasifier 100 may further be described in terms of the vertical alignment of components. From the bottom of Gasifier 100 to the top of Gasifier 100, Arc plasma chamber bottom height 410 is situated below Arc plasma torch height 413 which is situated below Feed conveyor height 416 which is situated below Internal orifice height 418 which is situated below Microwave source height 420 which is situated below Microwave plasma chamber top height 423. In cases in which components are not in complete alignment, Arc plasma torch height 413 represents the average height of the centers of the individual arc plasma torches located within Arc plasma chamber 110. Similarly, Feed conveyor height 416 represents the average height of the centers of the individual feed conveyors located within Arc plasma chamber 110 and Microwave source height 420 represents the average height of the centers of the individual Microwave sources 210 located within Microwave plasma chamber 200. In the embodiment depicted in FIG. 1, a steam injection height representing the average height of the centers of the individual Steam injection holes 230 is the same as the Microwave source height 420.

As that phrase is used herein "microwave chamber height" represents the distance between Microwave plasma chamber top height 423 and Internal orifice height 418. As that phrase is used herein "microwave chamber aspect ratio" represents the microwave chamber height divided by the cross-sectional distance. The microwave chamber aspect ratio may, for example, be 1.0 with certain examples falling between 0.3 and 3.0 and a significant number of those examples falling between 0.7 and 2.0. As that phrase is used herein "arc plasma chamber height" represents the distance between Internal orifice height 418 and Arc plasma chamber bottom height 410. As that phrase is used herein "arc plasma aspect ratio" represents the microwave chamber height divided by the cross-sectional distance. The arc plasma aspect ratio may, for example, be 1.0 with certain examples falling between 0.3 and 3.0 and a significant number of those examples falling between 0.7 and 2.0. As that phrase is used herein the "chamber volume proportion" represents the microwave chamber volume divided by the arc plasma chamber volume. The chamber volume proportion may, for example, be 1.0 with certain examples falling between 0.3 and 3.0 and a significant number of those examples falling between 0.7 and 2.0.

As that phrase is used herein "orifice area proportion" represents the orifice cross sectional area divided by the microwave cross-sectional area. The orifice diameter proportion may, for example, be 0.017 with certain examples falling between 0.004 and 0.068 and a significant number of those examples falling between 0.011 and 0.043. As that phrase is used herein the "exhaust area proportion" represents the cross-sectional area of the gas exit divided by the microwave cross-sectional area. The exhaust area proportion may, for example, be 0.25 with certain examples falling between 0.05 and 0.70 and a significant number of those examples falling between 0.15 and 0.50.

The above-described embodiments have a number of independently useful individual features that have particular utility when used in combination with one another including combinations of features from embodiments described separately. There are, of course, other alternate embodiments which are obvious from the foregoing descriptions, which are intended to be included within the scope of the present application.

I claim:

1. A gasifier comprising:

a. a first chamber;

b. a second chamber;

c. at least three microwave sources;

d. at least three arc plasma torches;

e. a drain in fluid communication with the first chamber;

f. an exhaust port in fluid communication with the second chamber and g. a path of fluid communication between the exhaust port and the drain;

h. wherein the exhaust port is configured to convey syngas from the second chamber;

i. wherein the at least three arc plasma torches are aimed into the first chamber and j. wherein the at least three microwave sources are aimed into the second chamber.

2. The gasifier of claim 1 further comprising at least one feed conveyor.

3. The gasifier of claim 2 wherein the at least three microwave sources are located above the at least one feed conveyor.

4. The gasifier of claim 2 wherein the at least one feed conveyor is positioned above the at least three arc plasma torches.

5. The gasifier of claim 2 wherein the at least one feed conveyor is connected to the first chamber.

6. The gasifier of claim 2 wherein and the at least one feed conveyor is located below at least one steam injection port.

7. The gasifier of claim 2 further comprising a flow restriction between the first chamber and the second chamber wherein the at least one feed conveyor is located below the flow restriction.

8. The gasifier of claim 7 wherein the flow restriction is an orifice.

9. The gasifier of claim 1 wherein the first chamber is below the second chamber.

10. The gasifier of claim 1 wherein the at least three arc plasma torches are below the at least three microwave sources.

11. The gasifier of claim 1 wherein the second chamber has at least one steam injection port.

12. The gasifier of claim 1 further comprising a wall limiting the flow between the first chamber and the second chamber.

* * * * *